United States Patent [19]

Takenaka et al.

[11] Patent Number: 5,021,283

[45] Date of Patent: Jun. 4, 1991

[54] WOVEN FABRIC HAVING MULTI-LAYER STRUCTURE AND COMPOSITE MATERIAL COMPRISING THE WOVEN FABRIC

[75] Inventors: Koji Takenaka, Ishikawa; Eiji Sato, Nobeoka, both of Japan

[73] Assignee: Asahi Kasei Kogyo Kabushiki Kaisha, Osaka, Japan

[21] Appl. No.: 379,736

[22] Filed: Jul. 13, 1989

[30] Foreign Application Priority Data

| | | | |
|---|---|---|---|
| Mar. 31, 1987 | [JP] | Japan | 62-76364 |
| Mar. 31, 1987 | [JP] | Japan | 62-76365 |
| Dec. 19, 1987 | [JP] | Japan | 62-320153 |

[51] Int. Cl.[5] ..... B32B 3/12; D03D 1/00; D03D 11/02; D03D 15/00

[52] U.S. Cl. ..... 428/116; 139/384 R; 139/390; 139/420 A; 244/2; 244/133; 428/118; 428/252; 428/902

[58] Field of Search ..... 139/384 R, 390, 420 A; 244/2, 133; 428/116, 118, 252, 902

[56] References Cited

U.S. PATENT DOCUMENTS

| | | | |
|---|---|---|---|
| 2,502,101 | 3/1950 | Morgan et al. | 139/384 R |
| 3,048,198 | 8/1962 | Koppelman et al. | 139/410 |
| 3,102,559 | 9/1963 | Koppelman et al. | 139/384 R |
| 3,598,159 | 8/1971 | MacIntyre | 139/384 R |
| 3,943,980 | 3/1976 | Rheaume | 139/410 |
| 4,680,216 | 7/1987 | Jacaruso | 428/116 |
| 4,767,656 | 8/1988 | Chee et al. | 428/116 |

FOREIGN PATENT DOCUMENTS

| | | | |
|---|---|---|---|
| 703982 | 2/1965 | Canada | 139/384 R |

*Primary Examiner*—James C. Cannon

*Attorney, Agent, or Firm*—Finnegan, Henderson, Farabow, Garrett & Dunner

[57] ABSTRACT

Disclosed is a woven fabric having a plurality of fabric layers which are integrated through combined portions formed by interlacing warps or wefts of one of adjacent layers of some of warps or wefts of said one layer and warps or wefts of the other layer or some of warps or wefts of said other layer with common wefts or warps, wherein a set of adjacent four layers comprises recurring structural units comprising (A) a part having one combined portion formed by intermediate two layers, (B) a first non-combined part having no combined portion, (C) a part having two combined portions formed by subsequent two layers, respectively, and (B) a second non-combined part having no combined portion. A honeycomb structure having cells of a shape of tetragons, hexagons or a combination thereof is formed among the entire layers when the multi-layer fabric is expanded. 40–100 wt. % of the fibers constituting the fabric are organic fibers which are infusible or have a melting point of at least 300° C. and have an initial modulus of at least 250 g/d, and 0–60 wt. % of the fibers constituting the fabric are inorganic fibers or metal fibers. A composite material comprising the multi-layer fabric as a reinforcer and a thermoplastic resin as a matrix has good mechanical strengths and thermal resistance and is valuable, e.g., as a structural material for an aircraft.

7 Claims, 2 Drawing Sheets

WOVEN FABRIC HAVING MULTI-LAYER STRUCTURE AND COMPOSITE MATERIAL COMPRISING THE WOVEN FABRIC

This application is a continuation of application Ser. No. 07/174,858, filed Mar. 29, 1988 now abandoned.

BACKGROUND OF THE INVENTION (1) Field of the Invention

The present invention relates to a multi-layer woven fabric comprising a plurality of woven fabric layers and having a three-dimensional structure suitable as a reinforcing fiber for a fiber-reinforced composite material, and to a composite material comprising the multi-layer woven fabric as a reinforcer.

More specifically, the present invention relates to a multi-layer woven fabric in which honeycomb-like cells can be formed by a specific combination of combined portions and non-combined portions when the woven fabric is expanded, i.e., opened out, and to a high-grade composite material having excellent mechanical characteristics, which is obtained by combining this multi-layer woven fabric with a specific resin.

(2) Description of the Related Art

As one conventional composite material, there is known a structural material formed by bonding a surface member forming a surface layer to a core material having honeycomb-like structure (hereinafter referred to as "honeycomb core").

In general, conventional honeycomb cores are obtained by coating an adhesive in stripes spaced equidistantly on a thin sheet such as a paper, an aluminum foil or a film, laminating and bonding such adhesive-coated thin sheets, and expanding the bonded structure to form honeycomb-like structure having a multiplicity of cells.

It is known that a plane woven fabric composed of glass fibers or the like is used as the sheet material for forming a honeycomb core according to the abovementioned process, and it is also known that a composite material is prepared by impregnating this honeycomb core with a thermosetting resin such as an epoxy resin. However, this honeycomb core does not have a sufficient tensile strength, peel strength and shear strength of the bonded surfaces. Although the use of a honeycomb structural material as a structural material of an aircraft is now desired, a satisfactory honeycomb structure has not been obtained because of the abovementioned defect.

U.S. Pat. No. 3,102,559 discloses a composite material formed by impregnating a honeycomb structure woven from yarns composed of natural fibers, nylon fibers, glass fibers or the like with a thermosetting resin. In this composite material, the tensile strength of the bonded surfaces is improved and a relatively high compression strength is attained because the weaving honeycomb structure is combined with the thermosetting resin. However, this composite material is still unsatisfactory as a structural material for an aircraft, and since the composite material is brittle, if the stress is imposed repeatedly, the composite material is liable to be broken.

Furthermore, a composite material is known which comprises a mat of carbon fibers or aramid fibers impregnated with a thermosetting resin. Although this composite has a high tensile strength and an excellent compression strength, the composite material is brittle and still has an insufficient impact strength. Accordingly, application of the composite material to fields where the conditions are more severe than in the conventional fields, for example, application to the field of aircraft, is difficult, and the application range of the composite material is limited. A light weight is an important condition for application to the field of aircraft. In this composite material, if it is intended to decrease the weight, the tensile strength and compression strength must be reduced, and when stress is imposed repeatedly, the composite material is liable to be broken and the impact resistance degraded. Moreover, the composite material exhibits a poor durability and heat resistance, when an aircraft part is repeatedly exposed to a high temperature and a low temperature.

SUMMARY OF THE INVENTION

It is a primary object of the present invention to provide a woven fabric especially suitable for the production of a composite material which has a light weight, shows an excellent compression strength in a broad temperature range, is not broken when stress is imposed repeatedly, and has an excellent impact resistance, and further, to provide a composite material in which the above-mentioned properties are most effectively exerted, by using this woven fabric.

More specifically, in accordance with one aspect of the present invention, there is provided a woven fabric having a multi-layer structure, which comprises a plurality of woven fabric layers which are integrated through combined portions formed by interlacing warps or wefts of one of adjacent woven fabric layers or some of warps or wefts of said one woven fabric layer and warps or wefts of the other woven fabric layer or some of warps or wefts of said other woven fabric layer with common wefts or warps, wherein a set of adjacent four woven fabric layers comprises recurring structural units comprising (A) a part having one combined portion formed by intermediate two woven fabric layers, (B) a first non-combined part having no combined portion, (C) a part having two combined portions each formed by adjacent two woven fabric layers, respectively, and (B) a second non-combined part having no combined portion; a honeycomb structure having a plurality of cells having a shape of tetragons, hexagons or a combination of tetragons and hexagons is formed among the entire woven fabric layers when the multi-layer woven fabric is expanded in the thickness direction; and 40 to 100% by weight of the fibers constituting the woven fabric are organic fibers which are infusible or have a melting point of at least 300° C. and have an initial modulus of at least 250 g/d, and 0 to 60% by weight of the fibers constituting the woven fabric are inorganic fibers or metal fibers.

In accordance with another aspect of the present invention, there is provided a composite material having a honeycomb structure, which comprises as a matrix a thermoplastic resin having a heat distortion temperature of at least 150° C. and as a reinforcer the abovementioned woven fabric having a multi-layer structure, the amount of fibers constituting the multi-layer woven fabric being 20 to 70% by weight and the amount of the resin constituting the matrix being 80 to 30% by weight.

DESCRIPTION OF THE PREFERRED EMBODIMENTS

Figure 1:
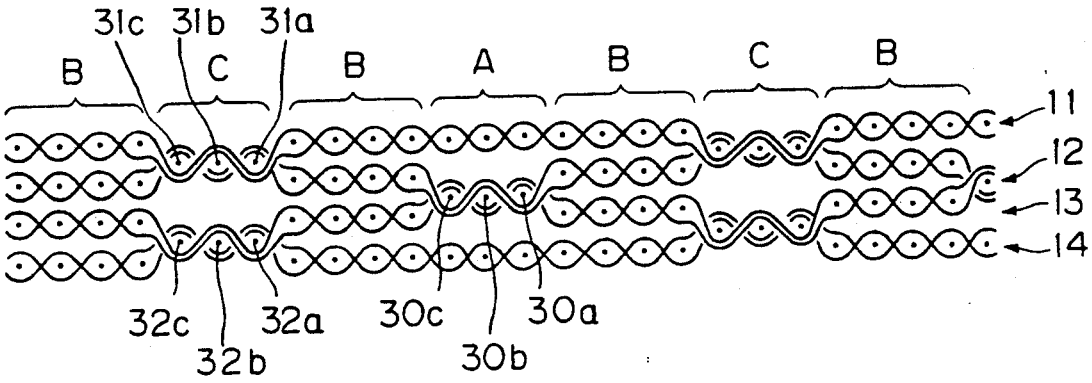
FIG. 1 is a diagram illustrating the sectional texture of a four-layer woven fabric according to the present invention.

The multi-layer woven fabric of the present invention comprises a plurality of woven fabric layers which are integrated through combined portions formed by interlacing warps or wefts of one of adjacent woven fabric layers or some of warps or wefts of said one woven fabric layer and warps or wefts of the other woven fabric layer or some of warps or wefts of said other woven fabric layer with common wefts or warps.

In the combined portion, all or some of warps of a two-layer woven fabric composed of a set of adjacent and confronting upper and lower yarns are interlaced as the upper or lower warps constituting the combined portion with one common weft inserted separately from the two-layer woven fabric, whereby one combined weave structure is formed.

In the multi-layer woven fabric of the present invention, a set of adjacent four layers comprises recurring structural units comprising (A) a part having one combined portion formed by intermediate two woven fabric layers, (B) a first non-combined part having no combined portion, (C) a part having two combined portions each formed by adjacent two woven fabric layers, respectively, and (B) a second non-combined part having no combined portion, and a honeycomb structure is formed among the entire woven fabric layers when the multi-layer woven fabric is expanded (i.e., opened) in the thickness direction.

By formation of the honeycomb structure among the entire woven fabric layers, a weight-decreasing effect is attained in a composite material prepared from this multi-layer woven fabric, and in turn, a high specific strength is realized in the composite material.

In the multi-layer woven fabric of the present invention, preferably the ratio of the density of the expanded multi-layer woven fabric to the density of the multi-layer woven fabric before the expansion is in the range of from 0.05 to 0.3, wherein the density of the expanded multi-layer woven fabric means an apparent density determined from the volume and weight measured when the multi-layer woven fabric is normally expanded so that the inner angles of respective tetragonal and/or hexagonal cells are equal.

The density varies according to the size of cells formed by the expansion, though the density is influenced to some extent by the fineness of warps or wefts constituting the woven fabric, the weave density, and the like. A multi-layer woven fabric having a higher density ratio is preferable as a reinforcer because it imparts a high mechanical performance, but the multi-layer woven fabric is disadvantageous from the viewpoint of the weight-decreasing effect. On the other hand, a multi-layer woven fabric having a low density ratio is not preferred as a reinforcer because the mechanical performance is degraded.

In a high-grade composite material intended in the present invention, such as a structural material for an aircraft, the intended object cannot be attained only by a light weight or high mechanical properties, but the weight must be high and the mechanical performance must be excellent. In the multi-layer woven fabric of the present invention, to satisfy this requirement, preferably the above-mentioned density ratio is in the range of from 0.05 to 0.3.

As pointed out hereinbefore, in the present invention, a honeycomb structure must be formed among the entire layers of the multi-layer woven fabric so that the ratio between the densities before and after the expansion is in a specific range. The structural units forming this honeycomb structure will now be described in detail with reference to the accompanying drawings illustrating embodiments of the present invention.

Figure 2:
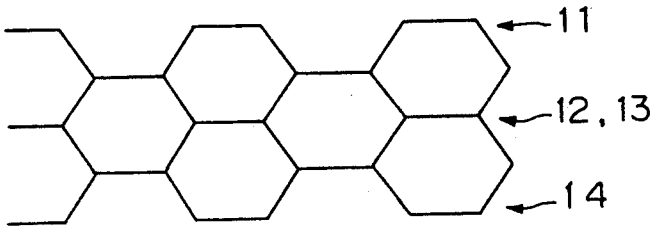
FIG. 2 is a diagram showing the shape of cells formed when the four-layer woven fabric shown in FIG. 1 is expanded.

FIG. 1 is a diagram illustrating the section of a set of four adjacent layers of the multi-layer woven fabric of the present invention. Referring to FIG. 1, woven fabric layers 11, 12, 13, and 14 having a plain weave texture have recurring structural units comprising continuous combined parts A and C for every four non-combined parts B. In part A, warps of second and third woven fabric layers 12 and 13 are interlaced with three continuously inserted combining wefts 30*a*, 30*b*, and 30*c* through plain weave textures to form a middle combined portion. This combined portion constitutes an independent single woven fabric layer. Therefore, part A has a three-layer structure comprising the first woven fabric layer 11, the middle combined portion layer, and the fourth woven fabric layer 14. In part C, warps of the first and second woven fabric layers 11 and 12 are interlaced with three continuously inserted combining wefts 31*a*, 31*b* and 31*c* through plain weave textures to form an upper combined portion, and warps of the third and fourth woven fabric layers 13 and 14 are interlaced with three continuously inserted combining wefts 32*a*, 32*b*, and 32*c* through plain weave textures to form a lower combined portion. Therefore, in part C, a two-layer structure is formed comprising the upper and lower combined portions. If the multi-layer woven fabric having the above-mentioned structure is expanded, a three-dimensional woven fabric having a honeycomb structure as shown in FIG. 2 is formed.

The lengths of the combined portions in parts A and C can be adjusted by increasing or decreasing the number of combined points of warps and wefts of the two woven fabric layers participating in the formation of the combined portions, and therefore, the number of combined points can be appropriately determined according to the intended use of the honeycomb structure or the desired honeycomb cell shape. For example, a honeycomb structure formed of modified tetragons or a honeycomb structure formed of a combination of tetragons and hexagons can be obtained by changing the length of the combined portions in parts A and C.

Figure 3:
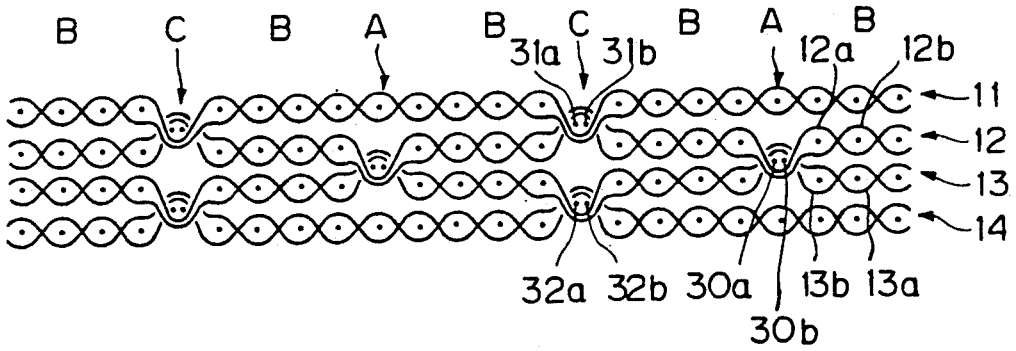
FIG. 3 is a diagram illustrating the sectional texture of another four-layer woven fabric according to the present invention.
Figure 4:
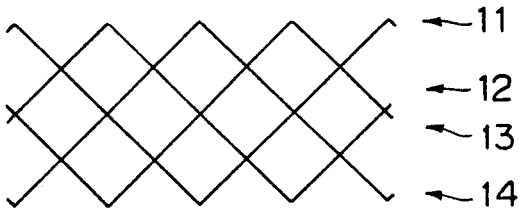
FIG. 4 is a diagram illustrating the shape of cells formed when the multi-layer woven fabric shown in FIG. 3 is expanded.

Referring to FIG. 3 illustrating another embodiment of the multi-layer woven fabric according to the present invention, each woven fabric layer has a plain weave texture and interlaminar combined portions are formed in parts A and C. In part A, warps 12*a* and 12*b* of the second woven fabric layers 12 and warps 13*a* and 13*b* of the third woven fabric layer 13 are interlaced with combining wefts 30*a* and 30*b* to form a middle combined portion. In part C, warps of the first woven fabric layer 11 and warps of the second woven fabric layer 12 are interlaced with combining wefts 31*a* and 31*b* to form an upper combined portion, and warps of the third woven fabric layer 13 and warps of the fourth woven fabric layer 14 are interlaced with combining wefts 32*a* and 32*b* to form a lower combined portion. In parts A and B, each combined portion in each layer is formed by one-point combination with two combining wefts for every four plain weave textures. Accordingly, if this four-layer woven fabric is expanded, a three-dimensional woven fabric having diamond-shaped cells in the section is formed, as shown in FIG. 4.

Figure 5:
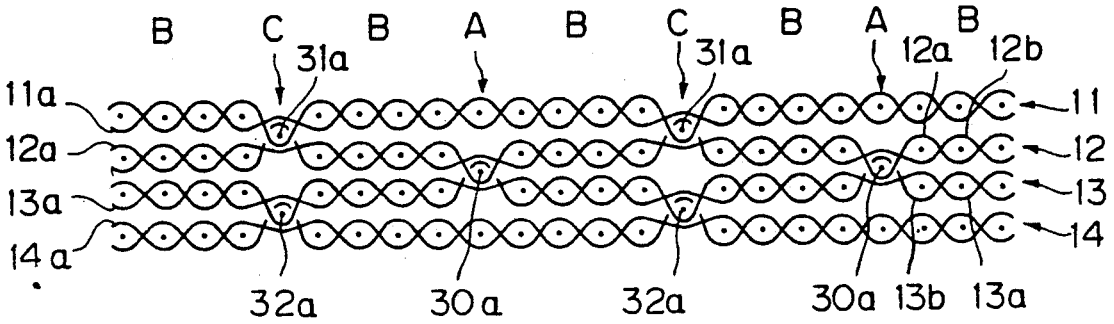
FIG. 5 is a diagram illustrating the sectional texture of still another four-layer woven fabric according to the present invention.

FIG. 5 shows an example of the multi-layer woven fabric in which some of warps 11*a*, 12*a*, 13*a*, and 14*a* of respective woven fabric layers 11 through 14 are interlaced with combining wefts 30*a*, 31*a*, and 32*a* to form combined parts A and C and non-combined parts B.

The length of the non-combined part B is not particularly critical. If the length of the non-combined part B is increased, a woven fabric having a honeycomb structure having larger polygonal cells can be obtained, and therefore, a fibrous material suitable for the production of a composite material satisfying the requirement of reducing the weight and increasing the size can be provided. In contrast, if the length of the non-combined part B is shortened, a multi-layer woven fabric having a dense and strong honeycomb structure can be provided, which is suitable as an industrial material.

The texture of each woven fabric layer is not limited to the above-mentioned plain weave texture, and other textures, for example, a twill weave texture and a satin weave texture, can be optionally selected.

In the multi-layer woven fabric of the present invention, at least four layers of woven fabrics are integrated to form honeycomb-like structure having cells in the section of the multi-layer woven fabric. The thickness of the multi-layer woven fabric can be increased by increasing the number of woven fabric layers to be superposed.

The multi-layer woven fabric of the present invention can be coincidently prepared by using a weaving machine having many shuttles on both sides, for example, a fly weaving machine provided with a plurality of dobbies or a rapier loom provided with a plurality of dobbies. Where the number of woven fabric layers to be superposed is increased, a jacquard opener or a plurality of warp beams are disposed and a rapier loom provided with a plurality of openers and a plurality of weft inserting mechanisms is used. Moreover, a loom provided with a mechanism for intermittently stopping feeding of warps and winding of a woven fabric synchronously with the movement of the weave texture is used.

In the present invention, 40 to 100% by weight of the total fibers constituting the multi-layer woven fabric must be organic fibers which are infusible or have a melting point of at least 300° C. and have an initial modulus of at least 250 g/d, and 0 to 60% by weight of the fibers must be inorganic fibers or metal fibers.

The constitution of the fibers forming the multi-layer woven fabric of the present invention is very important. The multi-layer woven fabric of the present invention is characterized in that 40 to 100% by weight of the total fibers of the multi-layer woven fabric are organic fibers which are infusible or have a melting point of at least 300° C. and have an initial modulus of at least 250 g/d.

Where the composite material is used as a structural material of an aircraft according to the object of the present invention, the mechanical performance as the structural material must be maintained in a broad temperature range of from a low temperature to a high temperature under severe conditions such that the material is repeatedly exposed to high and low temperatures. Also, the fibers per se acting as the reinforcer must have a high heat resistance. From this viewpoint, the fibers must be infusible or have a melting point of at least 300° C. Moreover, the fibers must not be broken even if subjected to a heat cycle where the fibers are exposed to high and low temperatures repeatedly. The specific organic fibers are advantageous over glass fibers and the like in that the impact resistance is excellent and the fibers are rarely broken even under a severe heat cycle.

The organic fibers used in the present invention must have an initial modulus of at least 250 g/d. Namely, the compression strength, which is one of the properties required for a honeycomb composite material, must be high. In the composite material, the compression stress is mainly applied in the length direction of warps or wefts constituting the woven fabric as the reinforcer, and in the case of fibers having a low initial modulus, deformation is easily caused and a high compression strength cannot be obtained. This liability to deformation is especially conspicuous at high temperatures. Accordingly, to obtain a composite material capable of retaining a high compression strength even at high temperatures, the initial modulus of organic fibers constituting the woven fabric must be high. Where the composite material is used as a structural material of an aircraft or the like according to the object of the present invention, the initial modulus of the organic fibers must be at least 250 g/d, preferably at least 300 g/d.

The mixing ratio of the organic fibers to inorganic fibers or metal fibers is important. If the amount of the organic fibers is smaller than 40% by weight and the amount of the inorganic fibers or metal fibers is larger than 60% by weight, although a high heat resistance is attained, high mechanical properties are difficult to maintain because of breakage of the fibers (especially, the inorganic fibers) under the above-mentioned heat cycle or metal fatigue in the case of the metal fibers. Moreover, since the inorganic fibers or metal fibers have a poor bendability, a satisfactory mechanical performance cannot be realized. In the multi-layer woven fabric of the present invention, it is not always necessary to use the inorganic fibers or metal fibers, and according to the object, the organic fibers can be used alone. The amount of inorganic fibers or metal fibers is optionally within the range of from 0 to 60% by weight according to the intended use.

As the organic fibers used in the present invention, which are infusible or have a melting point of at least 300° C., there can be mentioned, for example, fibers of aromatic polyamides represented by poly-m-phenylene isophthalamide and poly-p-phenylene terephthalamide; aromatic polyamide-imides derived from an aromatic diamine such as p-phenylene diamine or 4,4'-diaminodiphenyl ether and an aromatic tri- or tetrabasic acid such as trimellitic anhydride or pyromellitic anhydride; aromatic polyimides; aromatic polyesters derived from an aromatic dicarboxylic acid or a derivative thereof and an aromatic diol; polybenzoxazoles such as polybenzoxazole, polybenzo[1,2-d;5,4-d']bisoxazol-2,6-diyl-1,4-phenylene polybenzo[1,2-d;4,5-d']bisoxazol-2,6-diyl-1,4-phenylene, polybenzo[1,2-d;4,5-d']bisoxazol-2,6-diyl-4,4'-biphenylene and poly-6,6'-bibenzoxazol-2,2'-diyl-1,4-phenylene; and polybenzothiazoles such as polybenzothiazole, polybenzo[1,2-d;5,4-d']bisthiazol-2,6-diyl-1,4-phenylene, polybenzo[1,2-d;4,5-d']bisthiazol-2,6-diyl-4,4'-biphenylene and poly-6,6'-bibenzothiazol-2,2'-diyl-1,4-phenylene. Of these organic fibers, fibers of para-oriented aromatic polyamides such as poly-p-phenylene terephthalamide and poly(p-phenylene-3,4-diphenyl ether) terephthalamide, and fibers of poly-benzoxazoles or polybenzothiazoles are especially preferably used as the organic fibers in the present invention because high-tenacity fibers having a tensile strength of at least 18 g/d and an initial modulus of at least 300 g/d can be obtained.

As specific examples of the inorganic or metal fibers, there can be mentioned carbon fibers obtained from polyacrylonitrile fibers, pitch type carbon fibers obtained from pitch, glass fibers such as fibers of E glass, S glass and C glass, alumina fibers, silicon carbide fibers, and fibers of silicon nitride and boron nitride. Of these fibers, carbon fibers and glass fibers are preferably used in the present invention because of a good handling property and from the economical viewpoint.

These fibers are ordinarily used in the form of multifilament yarns as warps or wefts, and the intended object of the present invention can be attained even if the fibers are used in the form of spun yarns.

In connection with the thickness, that is, the fineness of the fibers of the present invention, preferably the single filament fineness is 0.1 to 50 d and the fineness of multi-filament yarns used as warps and wefts is 50 to 6,000 d, although these values not particularly critical.

The above-mentioned organic fibers and inorganic or metal fibers can be used as either warps or wefts for the production of the multi-layer woven fabric. Both kinds of fibers may be mix-woven, or one kind of fibers may be used as warps and the other kind of fibers may be used as wefts, according to need. Since inorganic fibers or metal fibers have a poor bending resistance and bendability, it is especially preferable that the organic fibers are used for warps and the inorganic or metal fibers are used for wefts. Of course, the organic fibers also can be used for wefts. In accordance with one preferred embodiment of the present invention, aromatic polyamide fibers, polybenzoxazole fibers or polybenzothiazole fibers having a tensile strength of at least 18 g/d and an initial modulus of at least 300 g/d are used for warps and carbon fibers or glass fibers are used for wefts.

In the multi-layer woven fabric of the present invention, the cover factors of warps and wefts constituting the woven fabric are represented by the following formulas, and preferably the sum of the cover factor kw in the warp direction and the cover factor kf in the weft direction is at least 300 and the sum of Kw and Kf defined below is at least 3,000:

$$kw = dw\sqrt{d/\rho}\ ,$$

$$kf = df\sqrt{d/\rho}\ ,$$

$$Kw = Dw\sqrt{d/\rho}\ \text{and}$$

$$Kf = Df\sqrt{d/\rho}$$

wherein kw and kf stand for cover factors of each layer constituting the multi-layer woven fabric in the warp direction and weft direction, respectively, Kw and Kf stand for cover factors of the entire multi-layer woven fabric in the warp direction and weft direction, respectively; dw and df stand for warp and weft densities of each layer expressed by the number of warps or wefts per inch, respectively; Dw and Df stand for total warp and weft densities of the entire multi-layer textile fabric, expressed by the number of warps or wefts per inch, respectively; d stands for the fineness (denier) of warps or wefts; and $\rho$ stands for the density (g/cm$^3$) of the fibers.

There is no established theory concerning the weaving limit by the cover factor. In the multi-layer woven fabric of the present invention, the cover factor is expressed by [cover factor of one layer x number of layers]. If the cover factor of one layer is small, the texture strength is reduced. Furthermore, even when the cover factor of one layer is large, if the cover factor of the multi-layer woven fabric as a whole is small, the strength of the formed composite material is degraded. In view of the foregoing, in the present invention, preferably the sum of kw and kf as the cover factor is at least 300, especially 300 to 5,000, and the sum of Kw and Kf is at least 3,000, especially 3,000 to 50,000, particularly especially 5,000 to 20,000.

The composite material of the present invention is a composite material consisting essentially of the above-mentioned multi-layer woven fabric of the present invention and a thermoplastic resin having a heat distortion temperature of at least 150° C.

In the present invention, the matrix resin must be a thermoplastic resin. Namely, as pointed out hereinbefore, a composite material used as a structural material for an aircraft or the like is repeatedly exposed to low and high temperatures and is used under severe conditions such that stress is repeatedly imposed under this heat cycle. The thermosetting resin customarily used as the matrix resin of the composite material is very brittle, and if the thermosetting resin undergoes a repeated imposition of the stress under the repeated heat cycle of low and high temperatures, the thermosetting resin is very liable to be broken. In contrast, in the composite material of the present invention, since a specific thermoplastic resin is used as the matrix resin, the brittleness of the resin per se is low, and even if the composite material undergoes a repeated imposition of stress under a repeated heat cycle of low and high temperatures, few cracks are formed in the resin, with the result that the structural material is not broken and the impact resistance is improved.

Since a specific thermoplastic resin is used as the matrix resin, the resin is deformed in follow-up with the deformation of reinforcing fibers constituting the multi-layer woven fabric and the performances of the reinforcing fibers can be completely utilized. Therefore, mechanical strength characteristics such as breaking strength and tensile strength are increased and a very high reinforcing effect can be attained.

In view of the foregoing, the rigidity of the thermoplastic resin used in the present invention is ordinarily determined according to the deformability of the reinforcing fibers used. Namely, in the present invention, preferably a thermoplastic resin having an elongation equal to or higher than the elongation of the reinforcing fibers is used.

In the composite material of the present invention, the heat distortion temperature of the matrix resin must be at least 150° C. In order to obtain a composite material capable of exerting a high mechanical performance at high temperatures according to the object of the present invention, deformation of the composite material at high temperatures must not occur. For this purpose, the heat distortion temperature must be at least 150° C. A resin having a higher heat distortion temperature is preferred.

In the composite material of the present invention, the amount of fibers constituting the multi-layer woven fabric as the reinforcer must be 20 to 70% by weight and the amount of the thermoplastic resin as the matrix must be 80 to 30% by weight. Namely, if the amount of the multi-layer woven fabric as the reinforcer is larger than 70% by weight and the amount of the thermoplastic resin as the matrix is smaller than 30% by weight, it is difficult to cover the entire woven fabric with the thermoplastic resin, and even if the textile fabric is covered, a sufficient rigidity cannot be imparted to the formed composite material and, therefore, it is impossible to obtain a sufficiently high compression strength and shear strength. If the amount of the multi-layer woven fabric is smaller than 20% by weight and the amount of the thermoplastic resin exceeds 80% by weight, a composite material can be formed but a sufficient reinforcing effect cannot be realized by the fibers as the reinforcer, and a sufficiently high compression strength and shear strength cannot be obtained. Moreover, this composite material is liable to be deformed under the application of heat. Therefore, it is necessary to form a composite material by using the multi-layer woven fabric and thermoplastic resin in the above-mentioned amounts. If this requirement is satisfied, a composite material having a honeycomb structure, which has an especially excellent mechanical performance, can be obtained.

By dint of the above-mentioned structural features, the composite material of the present invention has a high tensile strength and compression strength over a very broad temperature range, and even under a repeated application of stress, the composite material is not broken and shows a very high impact resistance.

As the thermoplastic resin used for forming the composite material of the present invention, there can be mentioned, for example, a) aromatic polyamide-imides represented by the following formula:

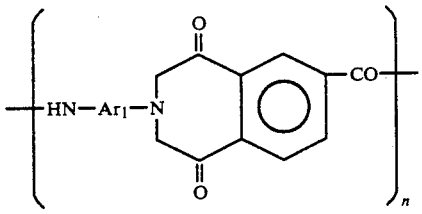

b) aromatic polyether-imides represented by the following general formula:

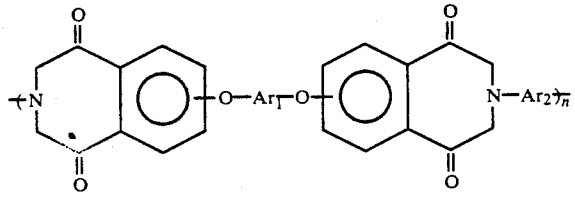

c) aromatic polyesters represented by the following general formula:

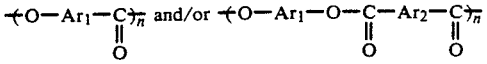

d) polyether-sulfones represented by the following general formula:

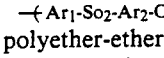

3) polyether-ether-ketones represented by the following general formula:

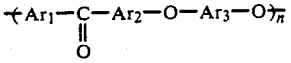

f) poly-p-phenylene sulfides represented by the following general formula:

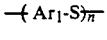

and g) poly-p-phenylene oxides represented by the following general formula:

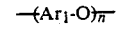

and in the foregoing general formulae a) through g), $Ar_1$, $Ar_2$ and $Ar_3$, which may be the same or different, stand for a substituted or unsubstituted divalent aromatic residue represented by

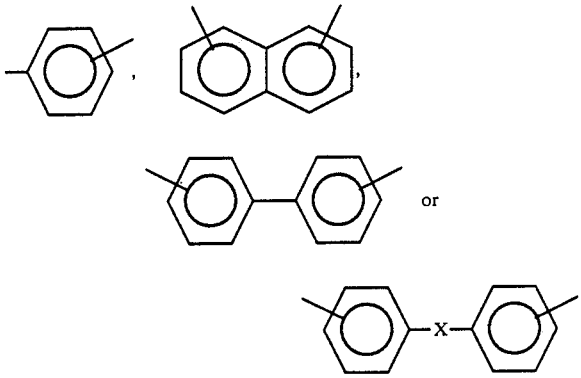

in which X is —O—, —$SO_2$—, —$CH_2$—or —$C(CH_3)_2$—.

Among these thermoplastic resins, aromatic polyether-imides, aromatic polyesters, polyether-sulfones and polyether-ether-ketones represented by the formulae b) through e) where each of $Ar_1$, $Ar_2$ and $Ar_3$ stands for a p-phenylene group are especially preferred for the production of the composite material of the present invention because they are thermoplastic polymers having a high distortion temperature and being melt-moldable. In the composite material of the present invention, the above-mentioned multi-layer woven fabric of the present invention is used as the reinforcer, and in order to sufficiently utilize the mechanical characteristics of the constituent fibers of the multi-layer woven fabric, which is integrally constructed, it is preferable to use a resin having a relatively high elongation as the matrix resin. Also from this viewpoint, the abovementioned polymers are especially preferably used for the production of the composite material of the present invention.

For the composite material of the present invention, the above-mentioned polymers can be used singly or in the form of mixtures of two or more thereof. If desired, a method may be adopted in which a composite material is once formed by using one polymer and the composite material is then treated with another polymer to form a composite material having a plurality of resin layers.

Preferably, the apparent density of the composite material of the present invention is 0.03 to 0.2 g/cm$^3$. The density differs according to the cell size of the expanded multi-layer woven fabric, the expansion degree, and the amount of the matrix resin. If the apparent density is lower than 0.03 g/cm$^3$, a sufficiently high compression strength is difficult to attain, and if the cell size is large in this case, the impact resistance is degraded. On the other hand, where the apparent density is higher than 0.2 g/cm$^3$, the mechanical characteristics of the composite material can be sufficiently increased, but the weight-reducing effect is reduced. For these reasons, preferably the apparent density of the composite material of the present invention is 0.03 to 0.2 g/cm$^3$, especially 0.03 to 0.18 g/cm$^3$, particularly especially 0.04 to 0.15 g/cm$^3$.

In the present invention, if the above-mentioned preferred multi-layer woven fabric is used, especially excellent effects can be attained in the formed composite material. For example, a composite material in which warps constituting the multi-layer woven fabric are composed of aromatic polyamide fibers and/or polybenzoxazole or polybenzothiazole fibers having a tensile strength of at least 18 g/d and an initial modulus of at least 300 g/d, wefts are composed of carbon fibers or glass fibers and the matrix resin is at least one member selected from the group consisting of the above-mentioned polyether-sulfones d), polyether-ether-ketones e) and aromatic polyamide-imides b) has an excellent mechanical performance and heat resistance performance and is very valuable as a structural composite material.

The process for the preparation of the composite material of the present invention is not particularly critical, and any means customarily adopted for the production of composite materials can be adopted. For example, a method can be adopted in which the expanded multi-layer textile fabric is immersed in the expanded state in a resin solution to sufficiently impregnate the woven fabric with the resin, the woven fabric is taken out from the immersion bath, the solvent is removed by evaporation or extraction with another solvent, and the formed composite material is washed and dried; a method in which the expanded multi-layer woven fabric is immersed in a melt of the resin; and a method in which the expanded multi-layer woven fabric is coated with a resin liquid by a brush or the like.

Additives such as an ultraviolet absorber, an antioxidant, a photostabilizer, and a water repellent can be incorporated into the composite material of the present invention, in so far as the intended object of the present invention is attained.

The present invention will now be described in detail with reference to the following examples. In the examples, all of "%" are by weight unless otherwise indicated, and the characteristics of the multi-layer woven fabric and composite material of the present invention were determined according to the following methods.

Cell size:

The multi-layer textile fabric was expanded so that the cells had an equilateral tetragonal or hexagonal shape, and the length between the confronting layer walls in each cell was measured as the cell size.

Mechanical performance of composite material:

The compression strength, compression elastic modulus, shear strength, and shear elastic modulus were measured according to MIL-STD-401B.

EXAMPLES 1 THROUGH 24

Multi-layer woven fabrics comprising structural units shown in FIG. 3 was formed by using a rapier loom provided with 32 dobbies.

In the structural unit shown in FIG. 3, each of woven fabric layers 11, 12, 13, and 14 having a plain weave texture had continuous combined portions in parts A and C for every four parts B. In part A, warps of the second and third woven fabric layers 12 and 13 were interlaced with three continuously inserted combining wefts 30*a*, 30*b*, and 30*c* through plain weave textures to form a middle combined portion. This combined portion formed an independent single woven fabric layer. Accordingly, part A had a three-layer structure comprising the first woven fabric layer 11, the middle combined portion layer and the fourth woven fabric layer 14. In part C, warps of the first and second woven fabric layers 11 and 12 were interlaced with three continuously inserted combining wefts 31*a*, 31*b* and 31*c* through plain weave textures to form an upper combined portion, and warps of the third and fourth woven fabric layers 13 and 14 were interlaced with three continuously inserted combining wefts 32*a*, 32*b* and 32*c* through plain weave textures to form a lower combined portion. Accordingly, in part C, a two-layer structure was formed by the upper and lower combined portions. If the so-constructed multi-layer woven fabric was developed, a three-dimensional woven fabric having a honeycomb structure was obtained.

With respect to each of the so-obtained multi-layer woven fabrics, the kinds of fibers used, the weave densities, and other characteristics are shown in Table 1.

As shown in Table 1, in Examples 1 through 4 according to the present invention, aramid multi-filament yarns of 380 d (Kevlar 49.T-968, Du Pont) were used as the warps, and 6,500 warps were arranged through 32 healds so that the warp density was 325 warps per inch and 16 layers were formed. As the wefts were used the same aramid multi-filament yarns of 380 d as the warps in Examples 1 and 2, glass filament yarns 68Tex (filament diameter of 9 μm, E type, Nippon Fiber Glass) in Example 3, and aramid multi-filament yarns of 1,140 d (Kevlar 49.T-968, Du Pont) in Example 4. The warp feed rate was adjusted so that the weft density was 325 or 244 wefts per inch, and the wefts were inserted while winding was intermittently stopped synchronously with the movement of the weave texture. In this manner, the weaving operation was carried out.

In Example 5, aramid multi-filament yarns of 380 d were used as the warps and yarns of 3,000 carbon fiber filaments (Asahi Nippon Carbon) were used as the wefts, and the weaving operation was carried out in the same manner as described above.

In Examples 6 through 24, multi-layer woven fabrics shown in Table 1 were formed wherein aramid multi-filament yarns (Kevlar 49.T-968, Du Pont) were used as the warps, and the same aramid multi-filament yarns as the warps, glass filament yarns (Nippon Fiber Glass) or carbon fiber yarns (Asahi Nippon Carbon) were used as the wefts.

In each of the multi-layer woven fabrics prepared in these examples, the cell shape was stable and each multi-layer woven fabric had a honeycomb structure having hexagonal cells, and when the woven fabric was expanded, equilateral hexagonal cells were formed. For comparison, when a similar multi-layer woven fabric composed of nylon 66 multi-filament yarns (see Comparative Example 1) was expanded, although cells of the peripheral portion held for the expansion had an equilateral hexagonal shape, cells of the interior portion were distorted. If the expanding force was increased so as to correct this distortion, the shapes of cells of the peripheral portion were deformed. Thus, it was confirmed that it was very difficult to perform the expansion so that uniform regular cell shapes were formed. Namely, it was confirmed that the multi-layer woven fabric of the present invention had an excellent stability and uniformity of the cell shapes. It is estimated that this effect is due to a high initial modulus of the fibers constituting the woven fabric.

COMPARATIVE EXAMPLE 1

By using nylon 66 multi-filament yarns of 1,260 d (Asahi Kasei Kogyo) (initial modulus of 48 g/d) as the warps and wefts, a 12-layer woven fabric having a warp density of 305 warps per inch, a weft density of 183 wefts per inch and a hexagonal cell size of ½ inch was prepared in the same manner as in Example 4. The characteristics of the multi-layer woven fabric are shown in Table 1. When the woven fabric was expanded, it was found that the uniformity and stability of the cell shapes of the woven fabric was inferior to those obtained in Examples 1 through 24.

TABLE 1

| Example No. | Warps[1] | Wefts[1] | Warp density (yarns per inch) | Weft density (yarns per inch) | Texture | Cell size (inch) | Thickness of fabric (mm) | Weight (g/m²) |
|---|---|---|---|---|---|---|---|---|
| 1 | AF380 | AF380 | 325 | 325 | Hexagonal, 16 layers | ⅛ | 25.8 | 1555 |
| 2 | AF380 | AF380 | 325 | 325 | " | ¼ | 51.2 | 1555 |
| 3 | AF380 | EGF68 *Tex* | 325 | 325 | " | ¼ | 51.2 | 1964 |
| 4 | AF380 | AF1140 | 325 | 244 | " | ⅛ | 26.0 | 2234 |
| 5 | AF380 | CF1000 *fit* | 122 | 122 | Hexagonal, 12 layers | ¼ | 38.6 | 1020 |
| 6 | AF1140 | AF1140 | 325 | 183 | Hexagonal, 16 layers | ¼ | 51.2 | 2987 |
| 7 | AF1140 | AF1140 | 214 | 183 | Hexagonal, 12 layers | 3/16 | 29.0 | 2362 |
| 8 | AF1140 | CF3000 *fit* | 214 | 152 | " | ¼ | 38.6 | 2636 |
| 9 | AF1420 | AF1420 | 91 | 76 | Hexagonal, 6 layers | ¾ | 57.5 | 1499 |
| 10 | AF1420 | AF1420 | 122 | 107 | " | ¾ | 57.5 | 1909 |
| 11 | AF1420 | CF3000 *fit* | 122 | 212 | Hexagonal, 12 layers | ⅜ | 95.6 | 2993 |
| 12 | AF1420 | AF1420 | 427 | 122 | " | ½ | 38.6 | 4894 |
| 13 | AF1420 | AF1420 | 305 | 244 | " | ¾ | 57.5 | 4905 |
| 14 | AF1420 | AF1420 | 305 | 183 | " | ½ | 38.6 | 4357 |
| 15 | AF1420 | AF1420 | 305 | 122 | " | ½ | 38.6 | 3809 |
| 16 | AF1420 | AF1420 | 122 | 305 | " | ¼ | 38.6 | 3825 |
| 17 | AF1420 | EGF135 *Tex* | 122 | 212 | " | ¼ | 38.6 | 2629 |
| 18 | AF1420 | AF1420 | 305 | 152 | Hexagonal, 6 layers | ⅜ | 29.0 | 4083 |
| 19 | AF1420 | AF1420 | 366 | 122 | " | ⅜ | 29 | 4352 |
| 20 | AF1420 | Si200 *Tex* | 91 | 107 | " | ½ | 38.6 | 1965 |
| 21 | AF1420 | AF1420 | 91 | 91 | " | ½ | 38.6 | 1635 |
| 22 | AF1420 | CF3000 *fit* | 91 | 91 | " | ½ | 38.6 | 1639 |
| 23 | AF195 | AF195 | 325 | 325 | Hexangonal, 16 layers | ⅛ | 25.8 | 776 |
| 24 | AF195 | CF1000 *fit* | 325 | 325 | " | ⅛ | 25.8 | 1360 |
| Comparative Example 1 | N66 1260 | N66 1260 | 305 | 183 | Hexagonal, 12 layers | ½ | 37.9 | 3866 |

| Example No. | $K_W$ | $K_F$ | $K_W + K_F$ | Apparent specific gravity (g/cm³) | Evaluation[2] Cell shape | Evaluation[2] Weaving property |
|---|---|---|---|---|---|---|
| 1 | 5398 | 5398 | 10796 | 0.060 | A | A |
| 2 | 5398 | 5398 | 10796 | 0.030 | A | A |
| 3 | 5398 | 5045 | 10443 | 0.038 | A | A |
| 4 | 5398 | 6408 | 11806 | 0.086 | A | A |
| 5 | 2026 | 1711 | 2737 | 0.026 | C | A |
| 6 | 8535 | 4806 | 13341 | 0.058 | A | A |
| 7 | 5620 | 4806 | 10426 | 0.081 | A | A |
| 8 | 5620 | 4450 | 10070 | 0.068 | A | A |
| 9 | 2926 | 2444 | 5370 | 0.026 | B | A |
| 10 | 3924 | 3441 | 7365 | 0.033 | A | A |
| 11 | 3924 | 6207 | 10131 | 0.031 | A | A |
| 12 | 13733 | 3924 | 17657 | 0.127 | A | C |
| 13 | 9810 | 7848 | 17658 | 0.085 | A | C |
| 14 | 9810 | 5886 | 15696 | 0.113 | A | B |
| 15 | 9810 | 3924 | 13734 | 0.099 | A | A |
| 16 | 3924 | 9810 | 13734 | 0.099 | A | A |
| 17 | 3924 | 4637 | 8561 | 0.068 | A | A |
| 18 | 9810 | 4889 | 14699 | 0.141 | A | B |
| 19 | 11772 | 3924 | 15696 | 0.150 | A | C |
| 20 | 2926 | 2993 | 5919 | 0.051 | A | A |
| 21 | 2786 | 2926 | 5712 | 0.042 | A | A |
| 22 | 2786 | 2664 | 5450 | 0.042 | A | A |
| 23 | 3817 | 3817 | 7634 | 0.030 | A | A |
| 24 | 3817 | 2993 | 6810 | 0.035 | A | A |
| Comparative | 10009 | 6005 | 16014 | 0.100 | C | B |

TABLE 1-continued

| Example 1 |
|---|

Note
[1]AF: aramid multi-filament yarn (Kevlar 49.T-968) (the numerical value indicates the yarn denier)
EGF: glass filament yarn (Nippon Fiber Glass) (the numerical value indicates the yarn denier)
CF: carbon fiber (Asahi Nippon Carbon) (the numerical value indicates the filament number of the yarn)
Si: silica-alumina fiber
N66: Nylon 66 multi-filament yarn (Asahi Kasei Kogyo) (the numerical value indicates the yarn denier)
[2]Cell shape
A: excellent, B: good, C: fair
Weaving property
A: excellent, B: good, C: fair

Example 25

This example illustrates the composite material of the present invention.

The multi-layer woven fabric composed of aramid multi-filament yarns as the warps and wefts and having hexagonal cells having a cell size of ½ inch, which was obtained in Example 14 and had a width of 700 mm and a length of 1,500 mm, was used.

Stainless steel rods were inserted into cells of the peripheral portion of the multi-layer woven fabric, and the woven fabric was expanded by pulling the stainless steel rods so that cells having an equilateral hexagonal shape were formed. The woven fabric in the expanded state was immersed in a solution containing 40% of polyether-sulfone (Victrex 4100P Sumitomo Kagaku) in N-methyl-2-pyrrolidone. In order to impregnate the fabric sufficiently with the resin, the immersing bath was sealed and evacuated by a vacuum pump so that the pressure was lower than 10 Torr. The immersing solution was maintained at room temperature. The impregnation treatment was thus conducted for about 2 hours, and the imprenated multi-layer woven fabric in the expanded state was taken out from the immersing bath and the dripping liquid was removed. Then, the woven fabric was placed in a hot air drying furnace at 150° C. for 3 hours to remove the solvent by evaporation. The temperature in the furnace was elevated to 180° C. and evaporation drying was carried out for 2 hours. The formed composite material solidified with evaporation of the solvent was taken out from the furnace. The composite material was cooled and cut by a diamond band-saw to obtain a composite material having a width of 600 mm, a length of 1,200 mm, and a thickness of 39.5 mm.

The obtained composite material comprised 55% of the fiber and 45% of the polyether-sulfone. The physical properties are shown in Table 2. It was confirmed that the obtained composite material was superior to the conventional honeycomb structural material shown in Table 2 in compression and shear characteristics.

COMPARATIVE EXAMPLE 2

A honeycomb multi-layer structure was prepared by treating the multi-layer structure woven fabric of nylon 66 multi-filament yarns obtained in Comparative Example 1 in the same manner as described in Example 25. Cells in the peripheral portion of the obtained composite material had an equilateral hexagonal shape, but cells in the inner portion had a distorted ellipsoidal shape. The mechanical performances of the obtained composite material are shown in Table 2. The composite material was inferior to the composite material of the present invention in all properties.

EXAMPLE 26

A composite material was prepared in the same manner as described in Example 25 except that the amount of the polyether-sulfone was changed. The amount of the polyether-sulfone was adjusted by changing the concentration of the polyether-sulfone dissolved in N-methyl-2-pyrrolidone. Other conditions were the same as in Example 25. The physical properties of the obtained composite material are shown in Table 2.

From the results shown in Table 2, it was confirmed that if the amount of the polyether-sulfone as the matrix was smaller than 30% by weight, satisfactory mechanical properties could not be obtained.

TABLE 2

| | Composition of composite material (% by weight) | | Performance of composite material | | | | | |
|---|---|---|---|---|---|---|---|---|
| Example No. | Multi-layer woven fabric | Polyether-sulfone | Apparent density (g/cm³) | Compression strength (kg/cm²) | Compression elastic modulus (kg/cm²) | Shear strength in L direction (kg/cm²) | Shear elastic modulus in L direction (kg/cm²) | Remarks |
| 25 | 55 | 45 | 0.092 | 46.5 | 3230 | 31.5 | 2040 | |
| 26 | 25 | 75 | 0.131 | 60.8 | 4430 | 38.4 | 3150 | |
| | 40 | 60 | 0.108 | 54.1 | 3750 | 34.6 | 2640 | |
| | 65 | 35 | 0.083 | 42.4 | 2650 | 21.8 | 1840 | |
| | 80 | 20 | 0.072 | 18.5 | 820 | 8.7 | 671 | Outside scope of present invention |
| Comparative Example 2 | 55 | 45 | 0.081 | 22.0 | 670 | 12.4 | 840 | |
| (reference) | HRH-10-3/16-4.0* | | 0.064 | 39.4 | 1970 | 17.2 | 650 | |

Note
*(NOMEX ® Honeycomb supplied by Showa Hikoki Kogyo)

EXAMPLE 27

A multi-layer woven fabric and a composite material were prepared in the same manner as described in Example 25 except that a polyether-imide resin (Ultem 1000, General Electric) was used instead of the polyethersulfone used in Example 25.

The characteristics of the obtained composite material were as shown below.

Multi-layer woven fabric (% by weight)/polyetherimide resin (% by weight)=60/40

Apparent density=0.092

Compression strength (kg/cm$^2$)/compression elastic modulus (kg/cm$^2$)=54.9/3,200

Shear strength (kg/cm$^2$) in L direction/shear elastic modulus (kg/cm$^2$) in L direction=32/3,510

Shear strength (kg/cm$^2$) in W direction/shear elastic modulus (kg/cm$^2$) in W direction =24.5/2,860

EXAMPLE 28

By using multi-filament yarns of 400 d, composed of polybenzoxazole, as the warps and wefts, a multi-layer woven fabric was prepared by arranging 324 warps through healds as in Example 1 so that the warp density was yarns per inch and an 8-layer structure was formed and inserting wefts as in Example 1 so that the weft density was 325 yarns per inch. The obtained multilayer woven fabric had hexagonal cells having a cell size of ⅛ inch, and the thickness of the woven fabric in the expanded state was 12.9 mm.

The multi-layer woven fabric was treated in the same manner as described in Example 25 to obtain a composite material comprising 50% of the polyethersulfone. The characteristic values of the obtained composite material were as shown below, and it was confirmed that the composite material and excellent performances.

Apparent density=0.089

Compression strength (kg/cm$^2$)/compression elastic modulus (kg/cm$^2$)=62.5/4,650

Shear strength (kg/cm$^2$) in L direction/shear elastic modulus (kg/cm$^2$) in L direction=37/3,930

Shear strength (kg/cm$^2$) in W direction/shear elastic modulus (kg/cm$^2$) in W direction=27/3,050

When the multi-layer woven fabric of the present invention having the above-mentioned structure is extended, there is formed a honeycomb structure, and this multi-layer woven fabric is characterized in that the respective woven fabric layers are integrated by interlacing warps or wefts of adjacent woven fabric layers with common wefts or warps. Therefore, interlaminar separation is not caused, and even though a high weight-decreasing effect is attained, the tensile strength and shear strength between adjacent layers are very high. Moreover, the structure is stable and the heat resistance is excellent. Accordingly, the multilayer woven fabric of the present invention is very suitable as a reinforcing woven fabric for the production of a composite material having such excellent characteristics.

The composite material of the present invention comprising this multi-layer woven fabric and a specific resin has a light weight and shows a high tensile strength and compression strength over a broad temperature range, and even if stress is imposed repeatedly on the composite material, the composite material is not broken, and the impact resistance is very high. By dint of these characteristic features, the composite material of the present invention is very valuable as a structural material for an aircraft.

We claim:

1. A woven fabric having a multi-layer structure, which comprises a plurality of woven fabric layers which are integrated through combined portions formed by interlacing warps or wefts of one of adjacent woven fabric layers or some of warps or wefts of said one woven fabric layer and warps or wefts of another woven fabric layer or some of warps or wefts of said other woven fabric layer with common wefts or warps, wherein a set of adjacent four woven fabric layers comprises recurring structural units comprising (A) a part having one combined portion formed by intermediate two woven fabric layers, (B) a first non-combined part having no combined portion, (C) a part having two combined portions each formed by adjacent two woven fabric layers, respectively, and (B) a second non-combined part having no combined portion; a honeycomb structure having a plurality of cells having a shape of tetragons, hexagons or a combination of tetragons and hexagons is formed among the entire woven fabric layers when the multi-layer woven fabric is expanded in the thickness direction; and 40 to 100% by weight of the fibers constituting the woven fabric are one or more kinds of organic fibers selected from the group consisting of aromatic polyamide fibers, polybenzoxazole fibers and polybenzothiazole fibers, which have a tensile strength of at least 18 g/d and an initial modulus of at least 300 g/d, and 0 to 60% by weight of the fibers constituting the woven fabric are carbon fibers wherein the ratio of the density of the expanded multi-layer woven fabric to the density of the multi-layer woven fabric before the expansion is in the range of from 0.05 to 0.3, the density of the expanded multi-layer woven fabric being an apparent density determined from the volume and weight measured when the multi-layer woven fabric is normally expanded so that the inner angles of each tetragonal or hexagonal cell are equal; and the sum of the cover factor kw in the warp direction and the cover factor kf in the weft direction, which are represented by the following formulas, is at least 300 and the sum of the cover factor Kw in the warp direction and the cover factor Kf in the weft direction, which are represented by the following formulas, is at least 3,000:

$$kw = dw\sqrt{d/\rho}$$

$$kf = df\sqrt{d/\rho}$$

$$Kw = Dw\sqrt{d/\rho} \text{ and}$$

$$Kf = Df\sqrt{d/\rho}$$

wherein kw and kf stand for cover factors of each layer constituting the multi-layer woven fabric in the warp direction and weft direction, respectively, Kw and Kf stand for cover factors of the entire multi-layer woven fabric in the warp direction and weft direction, respectively; dw and df stand for warp and weft densities of each layer, expressed by the number of warps or wefts per inch respectively; Dw and Df stand for total warp and weft densities of the entire multi-layer woven fabric, expressed by the number of warps or wefts per inch, respectively; d stands for the fineness (denier) of warps or wefts; and $\rho$ stands for the density (g/cm$^3$) of the fibers.

2. A woven fabric having a multi-layer structure according to claim 1, wherein the warps constituting the woven fabric are composed of fibers selected from the group consisting of aromatic polyamide fibers, polybenzoxazole fibers and polybenzothiazole fibers, which have a tensile strength of at least 18 g/d and an initial modulus of at least 300 g/d.

3. A woven fabric having a multi-layer structure according to claim 1, wherein the wefts are composed of carbon fibers or glass fibers.

4. A composite material having a honeycomb structure, which comprises as a matrix a thermoplastic resin having a heat distortion temperature of at least 150° C. and as a reinforcer an expanded woven fabric having a multi-layer structure, the amount of fibers constituting the multi-layer woven fabric being 20 to 70% by weight and the amount of the resin constituting the matrix being 80 to 30% by weight, based on the weight of the composite material, said multi-layer woven fabric comprising a plurality of woven fabric layers which are integrated through combined portion formed by interlacing warps or wefts of one of adjacent woven fabric layers or some of warps or wefts of said one woven fabric layer and warps or wefts of the other woven fabric layer or some of warps or wefts of said other woven fabric layer with common wefts or warps, wherein a set of adjacent four woven fabric layers comprises recurring structural unit comprising (A) a part having one combined portion formed by intermediate two woven fabric layers, (B) a first non-combined part having no combined portion, (C) a part having two combined portions each formed by adjacent two woven fabric layers, respectively, and (B) a second non-combined part having no combined portion; a honeycomb shape of tetragons, hexagons or a combination of tetragons and hexagons is formed among the entire woven fabric layers when the multi-layer woven fabric is expanded in the thickness direction; 40 to 100% by weight of the fibers constituting the woven fabric are one or more kinds of organic fibers selected from the group consisting of aromatic polyamide fibers, polybenzoxazole fibers and polybenzothiazole fibers, which have a tensile strength of at least 300 g/d, and 0 to 60% by weight of the fibers constituting the woven fabric are inorganic fibers or metal fibers wherein the ratio of the density of the expanded multi-layer woven fabric to the density of the multi-layer woven fabric before the expansion is in the range of from 0.05 to 0.3, the density of the expanded multi-layer woven fabric being an apparent density determined from the volume and weight measured when the multi-layer woven fabric is normally expanded so that the inner angles of each tetragonal or hexagonal cell are equal; and the sum of the cover factor kw in the warp direction and the cover factor kf in the weft direction, which are represented by the following formulas, is at least 300 and the sum of the cover factor kw in the warp direction and the cover factor Kf in the weft direction, which are represented by the following formulas, is at least 3,000:

$$kw = dw\sqrt{d/\rho}$$

$$kf = df\sqrt{d/\rho}$$

$$Kw = Dw\sqrt{d/\rho} \text{ and}$$

$$Kf = Df\sqrt{d/\rho}$$

wherein kw and kf stand for cover factors of each layer constituting the multi-layer woven fabric in the warp direction and weft direction, respectively, Kw and Kf stand for cover factor of the entire multi-layer woven fabric in the warp direction and weft direction, respectively; dw and df stand for warp and weft densities of each layer, expressed by the number of warps or wefts per inch respectively; Dw and Df stand for total warp and weft densities of the entire multi-layer woven fabric, expressed by the number of warps or wefts per inch, respectively; d stands for the fineness (denier) of warps or wefts; and $\rho$ stands for the density (g/cm$^3$) of the fibers.

5. A composite material according to claim 4, wherein the resin constituting the matrix is at least one polymer selected from the group consisting of:

a) aromatic polyamide-imides represented by the following general formula:

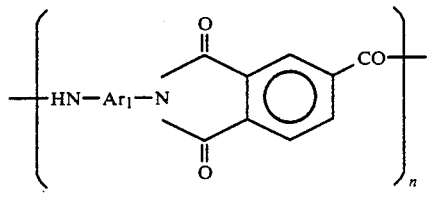

b) aromatic polyether-imides represented by the following general formula:

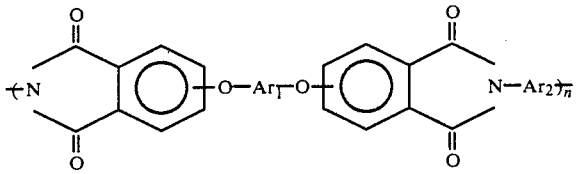

c) aromatic polyesters represented by the following general formula:

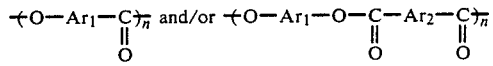

d) polyether-sulfones represented by the following general formula:

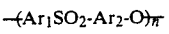

3) polyether-ether-ketones represented by the following general formula:

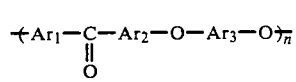

f) poly-p-phenylene sulfides represented by the following general formula:

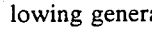

and g) poly-p-phenylene oxides represented by the following general formula:

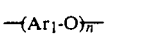

and in the foregoing general formulae a) through g), $Ar_1$, $Ar_2$ and $Ar_3$, which may be the same or different, stand for a substituted or unsubstituted divalent aromatic residue represented by

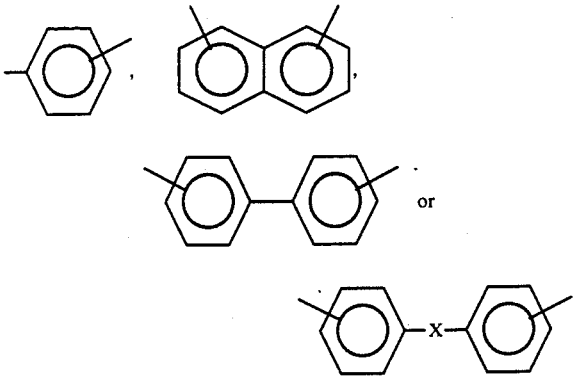

in which X is —O—, —$SO_2$—, —$CH_2$— or —$C(CH_3)_2$—.

6. A composite material according to claim 4, wherein the apparent density of the composite material is 0.03 to 0.2 g/$cm^3$.

7. A composite material according to claim 4, wherein the warps constituting the multi-layer woven fabric are composed of fibers selected from the group consisting of aromatic polyamide fibers, polybenzoxazole fibers and polybenzothiazole fibers, which have a tensile strength of at least 18 g/d and an initial modulus of at least 300 g/d, the wefts constituting the multi-layer woven fabric are composed of carbon fibers and the matrix resin is at least one member selected from the group consisting of d) the polyether-sulfones, e) the polyether-ether-ketones and b) the polyether-imides.

* * * * *